US008376139B2

(12) United States Patent
Arnold

(10) Patent No.: US 8,376,139 B2
(45) Date of Patent: Feb. 19, 2013

(54) PACKING FOR BICYCLE PEDALS

(75) Inventor: Franc Arnold, Koblenz (DE)

(73) Assignee: RTI Sports Vertrieb von Sportartikeln GmbH (DE)

( * ) Notice: Subject to any disclaimer, the term of this patent is extended or adjusted under 35 U.S.C. 154(b) by 0 days.

(21) Appl. No.: 13/222,774

(22) Filed: Aug. 31, 2011

(65) Prior Publication Data

US 2012/0048758 A1 Mar. 1, 2012

(30) Foreign Application Priority Data

Aug. 31, 2010 (DE) ..... 20 2010 012 048 U

(51) Int. Cl.
*B65D 73/00* (2006.01)

(52) U.S. Cl. ..... 206/462; 206/463; 206/471; 206/730; 206/806; 24/458

(58) Field of Classification Search ..... 206/461–463, 206/335, 730–735, 471, 806; 24/20 R
See application file for complete search history.

(56) References Cited

U.S. PATENT DOCUMENTS

| | | | | |
|---|---|---|---|---|
| 2,597,342 | A * | 5/1952 | Lang | 411/460 |
| 3,444,993 | A | 5/1969 | Lunsford | |
| 4,005,776 | A * | 2/1977 | Seeley | 206/306 |
| 4,438,845 | A | 3/1984 | Mochow | |
| 4,531,636 | A * | 7/1985 | Salacuse | 206/461 |
| 4,669,610 | A | 6/1987 | Lindsay et al. | |
| 4,946,034 | A * | 8/1990 | Matsubara | 206/315.11 |
| 6,474,539 | B1 * | 11/2002 | Van Der Horst | 229/120.14 |
| 6,543,310 | B1 * | 4/2003 | Baker et al. | 74/594.6 |
| 6,877,602 | B2 * | 4/2005 | Nichol, Jr. | 206/297 |
| 2002/0117409 | A1 * | 8/2002 | Okin et al. | 206/216 |
| 2002/0166785 | A1 * | 11/2002 | Worrick, III | 206/349 |
| 2002/0189955 | A1 * | 12/2002 | Waters | 206/5 |
| 2003/0139276 | A1 * | 7/2003 | Lozano | 493/480 |
| 2007/0062836 | A1 * | 3/2007 | Nazari | 206/461 |
| 2007/0187273 | A1 * | 8/2007 | Grosskopf | 206/462 |

FOREIGN PATENT DOCUMENTS

| | | |
|---|---|---|
| DE | 6908335 | 6/1969 |
| DE | 60009081 T2 | 8/2004 |
| DE | 60214925 T2 | 3/2007 |
| DE | 202008011712 U1 | 9/2008 |
| JP | 2002085218 A | 9/2000 |

* cited by examiner

*Primary Examiner* — J. Gregory Pickett
*Assistant Examiner* — Mollie Llewellyn
(74) *Attorney, Agent, or Firm* — Clements Bernard PLLC; Gregory N. Clements

(57) ABSTRACT

A packing for bicycle pedals (12*a*,12*b*) comprises a pedestal (14) for placing the first pedal (12*a*) thereon. The shape of the pedestal (14) is adapted to the outer contours of the first pedal (12*a*). The packing further comprises a fixing means (16) for fixing the first pedal (12*a*) on the pedestal (14), and a receiving cavity (18) for the second pedal (12*b*).

11 Claims, 2 Drawing Sheets

PACKING FOR BICYCLE PEDALS

BACKGROUND OF THE INVENTION

1. Field of the Invention

The present invention relates to a packing for bicycle pedals.

2. Description of the Prior Art

Bicycle pedals are sold as accessories for bicycles and, for keeping them available or presenting them to a customer in a store, have to be contained in a suitable packing.

It is known to provide boxes for packing the bicycle pedals in them. Such boxes are e.g. of the type to be folded open, wherein two recesses are arranged in the interior of such a box for receiving the pedals.

In case of such product packings, a customer or interested observer can neither see nor touch the pedal without opening the packing. When the packing has been opened, the customer can take out the pedals. In this situation, however, there is an increased risk of shoplifting because, after removal of the packing, it may be quite easy for the customer to pocket the pedals.

Particularly in pedals which are not designed as click pedals, it may be important for a customer or interested person to visually examine or touch the pedals before possibly buying them, since the decision as to whether or not to buy them will often depend on customer-relevant features such as, e.g., skid resistance, perceived overall quality, haptics and other visually recognizable aspects.

It is an object of the invention to provide a packing for bicycle pedals which makes it possible for an interested person to visually examine and to touch one of the pedals without opening or damaging the product packing.

According to the invention, the above object is achieved by the features defined in claim 1.

SUMMARY OF THE INVENTION

A packing for bicycle pedals comprises a pedestal for placing the first pedal onto it. The shape of the pedestal is adapted to the outer contours of the first pedal. This means that the shape of the pedestal and particularly of the side of the pedestal facing toward the pedal is of a configuration adapted to at least a part of the outer contours of the first pedal. Particularly, the upper side of the pedestal, i.e. the side facing away from the packing, is adapted to the first pedal. Thus, for instance, the pedestal can comprise projections at those sites where the first pedal comprises recesses. Conversely, the pedestal can comprise recesses or cutouts at those sites where the first pedal comprises projections so that the projections can extend into the recesses of the pedestal. In the context of the present invention, a pedestal is to be understood as an element which makes it possible to lay the first pedal onto this element while, further, the pedestal forms a raised portion so that a hollow space is formed under the pedestal.

According to the invention, the packing further comprises a fixing means for fixing the first pedal on the pedestal. By said fixing means, the first pedal can be fixed on the pedestal in such a manner that the position of the first pedal relative to the pedestal is defined and, further, that a predetermined force has to be applied to remove the first pedal again from the pedestal. This can be a relatively small force so that it may be required to use further fastening elements for attaching the pedal to the pedestal in a safer way. Thus, according to the invention, the fixing means will effect only an initial fixation of the pedal.

The device of the invention further comprises a receiving cavity for the second pedal. Thus, according to the invention, the first pedal is arranged on the pedestal while the second pedal is contained in said receiving cavity.

Therefore, the packing of the invention makes it possible for the customer to observe and touch the first pedal arranged on the pedestal without the need to remove the first pedal from the packing or to open or destroy the packing. A customer will thus be able to observe and touch the pedal without seeking the help of a salesperson who, e.g. for reasons of theft protection, would have to assist the customer in opening the package. It is assumed to be sufficient for the customer to observe and/or touch a sole pedal because the second pedal is always designed in correspondence to the first pedal, thus rendering it unnecessary that both pedals are visible before a buying decision.

It is preferred that the receiving cavity for the second pedal is arranged behind the pedestal when viewed from the side of the packing facing toward the observer or customer. This is to say that the customer or observer will look from the front onto the first pedal arranged on the pedestal. Thus, as seen from the observer, the pedestal is arranged behind the first pedal. Behind the pedestal, the receiving cavity for the second pedal is arranged. This receiving cavity can comprise the inner volume of the pedestal, i.e. the space arranged directly behind the pedestal, so that the second pedal extends into this cavity. This is particularly advantageous because this space can be used for accommodating the second pedal and the packing can thus have a space-saving design.

In the context of the invention, the side facing toward the observer is understood to be that side of the packing which a customer will usually see when the pedals in their packing are presented in a store. This side can be the front side of the packing which e.g. is provided with product information in the form of text or pictures. Frequently, product packings for smaller accessories are hung behind each other on a bar, with each packing having a recess through which said bar is fitted. Thus, in this case, the packing will be viewed by the customer from the front so that this side corresponds to the side facing toward the observer. In a usual arrangement in a store, the rear side of the packing will be facing away from the customer and, e.g., can be given a more simple graphic design.

It is preferred that the front side of the receiving cavity, i.e. the side of the receiving cavity facing toward the observer, is closed by the pedestal and that the rear side and optionally existing side portions of the receiving cavity are closed by at least one rear wall element. In case that the rear side of the receiving cavity is of a parallelepipedic shape, the receiving cavity can comprise a rear wall element at the back and four side wall elements. The receiving cavity can also have other geometric shapes which are adapted to the dimensions and the shape of the second pedal.

It is preferred that said rear wall element is formed by a base element of the packing. The packing can further comprise a front element. Via said front element, said base element can be connected to the pedestal. The front element, the pedestal and the base element can thus be three separate elements which, in the assembled state of a packing, are connected to each other. For instance, the front element can be connected to the base element by gluing.

According to a preferred embodiment, the front element comprises a recess whose shape and dimensions substantially correspond to those of the pedestal. In the assembled state of the packing, the pedestal extends from the rear through said recess in the direction of the observer. In this regard, the pedestal can be provided with a preferably continuous edge on its lower region for keeping the pedestal fixed in position in the recess of the front element. Said edge can extend parallel to the front element between the latter and the base element. Thus, the edge prevents the pedestal from falling out toward the front, i.e. in the direction of the observer, through the recess of the front element. In other words, the pedestal is held in a form-locking manner between the front element and the base element. According to an alternative embodiment, the front element and the pedestal can be formed in one piece and be connected to the base element e.g. by gluing.

A two-part configuration of the front element and the pedestal is advantageous in that the pedestal can be made of a less complex material, e.g. of papier-mâché while the front element is made of cardboard. The front element can be printed with text or pictorial information about the product whereas the pedestal is not in need of a complex graphic design since it will anyway be visible to the observer merely to a limited extent. Also the base element can be made of cardboard, or alternatively of a plastic material.

According to a further embodiment, the pedestal comprises two domes, their shapes and dimensions being adapted to two recesses formed in the pedal which is to be packed. The packing of the invention is suited particularly for pedals which are not designed as click pedals, since such pedals usually comprise a respective recess between the pedal axis and the front and respectively rear end of the pedal.

The two domes of the pedestal can extend into these two recesses, it being preferred that the two domes comprise, at their tip, an elastically deformable rear-engagement portion for engagement behind an undercut of the first pedal. Said undercut is preferably arranged in the interior of the pedal so that it is not necessary that the domes are fitted entirely through the recesses of the pedal and project out from the upper side of the pedal. Instead, it is sufficient that the domes project from below into the recesses of the pedal and extend all the way to the undercut arranged in the interior of the pedal and grip behind the undercut. Thus, it is not directly evident to the observer in what manner the pedal is held on the pedestal. Said elastically deformable rear-engagement portion can be formed e.g. by a projection running around the dome at the tip or upper region thereof and at least partially extending parallel to the front element. For fixing the pedal on the pedestal, said projection can be pressed back by application of a low force and, once it has come to grip behind the undercut in the first pedal, will snap back into its original position by its inherent elasticity.

It is preferred that the two domes of the pedestal are arranged at a mutual distance in a direction transverse to the axis of the first pedal so that the axis of the first pedal can be received in the intermediate space.

Further, it is preferred that, on its side facing toward the observer, the receiving cavity for the second pedal is closed by the pedestal and/or a front element so that the contents of the receiving cavity will not be visible to the observer.

According to a preferred embodiment, the packing comprises an elastically deformable fastening clamp, preferably made of metal, for attachment of the first pedal to the pedestal. Said fastening clamp comprises two fastening projections wherein, with the first pedal mounted to the pedestal, a respective fastening projection is fitted into one of the two domes of the pedestal and, in addition to the elastically deformable rear-engagement portion of the dome, engages behind an undercut of the first pedal. Therefore, with the aid of the fastening clamp, a more stable connection can be established between the pedestal and the first pedal. The first pedal is thus connected also to the packing. Preferably, the fastening clamp is configured to the effect that the first pedal cannot be removed from the pedestal, or at least not without application of a larger force or of violence. This effect can be achieved e.g. by selecting the tension of the fastening clamp in such a manner that, in the mounted state, the fastening clamp can be removed only from the lower portion of the pedestal, since the two fastening projections are biased against a respective undercut of the first pedal and thus have to be released only from the lower portion of the pedestal.

Further, it can be provided that the first and the second pedal are arranged above each other in the packing, wherein the pedestal is arranged between them and wherein, preferably, the first and the second pedal are connected to each other and to the packing via a recess in the pedestal with the aid of a connection element, e.g. a twistable wire. Said connection element can e.g. be guided around the axis or other components of the pedal so that the first pedal is connected to the packing by the fixing means of the pedestal, the fastening clamp and said connection element. All of these elements are nonetheless not or hardly visible to the observer so that he/she will able to view and touch the pedal in its entirety.

It is preferred that, when the first pedal has been fixed on the pedestal of the packing, the first pedal is in contact with the pedestal only by the pedal's lower portion, wherein the fixation and/or the attachment of the pedal on the pedestal occur only at the lower portion of the pedal so that the other five faces of the pedal are not covered by any element of the packing and thus are visible to—and touchable by—an interested person.

According to a further preferred embodiment, the pedestal comprises, at a side thereof, a recess for receiving an abutment element of the first pedal. This abutment element can extend on the inner side of the footplate of the pedal vertically to the footplate and at an angle of e.g. 60° to 90° relative to the pedal axis and, particularly, vertically to the pedal axis away from the pedal. The abutment element has the function, in the mounted state of the pedal, to indicate to the cyclist an end position up to which he/she can set his/her foot inward in the direction of the pedal crank. In this regard, it is considered that, when riding a bicycle, it is advantageous to place both feet as far as possible inward on the pedals, the closest standing position being defined by said abutments on both inward sides of the pedal.

It is further preferred that the packing comprises a second receiving cavity for accommodating an instruction manual or other product information, said second receiving cavity being preferably formed between a base element and a front element of the packing.

BRIEF DESCRIPTION OF THE DRAWINGS

A full and enabling disclosure of the present invention, including the best mode thereof, enabling one of ordinary skill in the art to carry out the invention, is set forth in greater detail in the following description, including reference to the accompanying drawing in which.

DETAILED DESCRIPTION OF PREFERRED EMBODIMENTS

Figure 1:
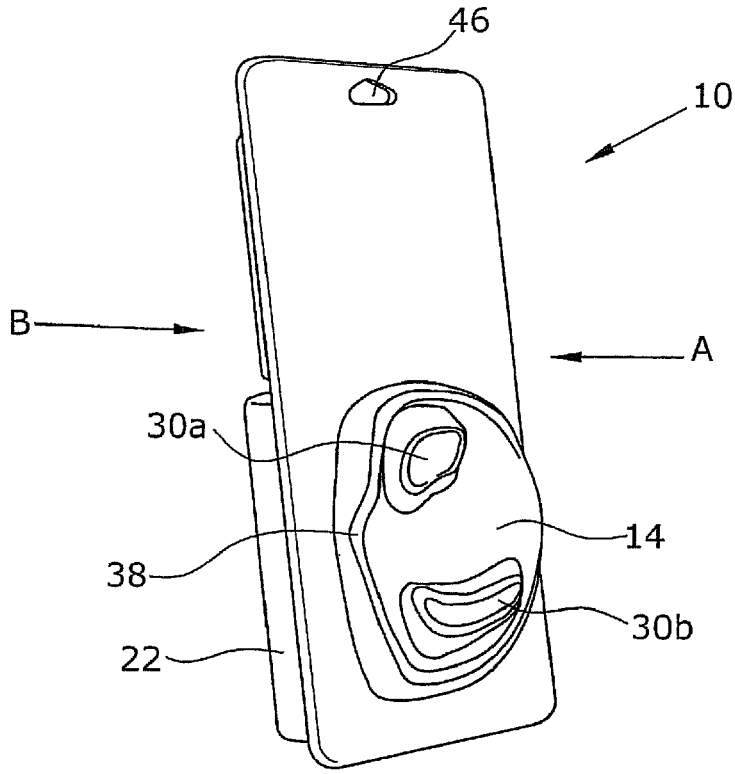
FIG. 1 is a perspective view of the packing of the invention in the assembled state.
Figure 2:
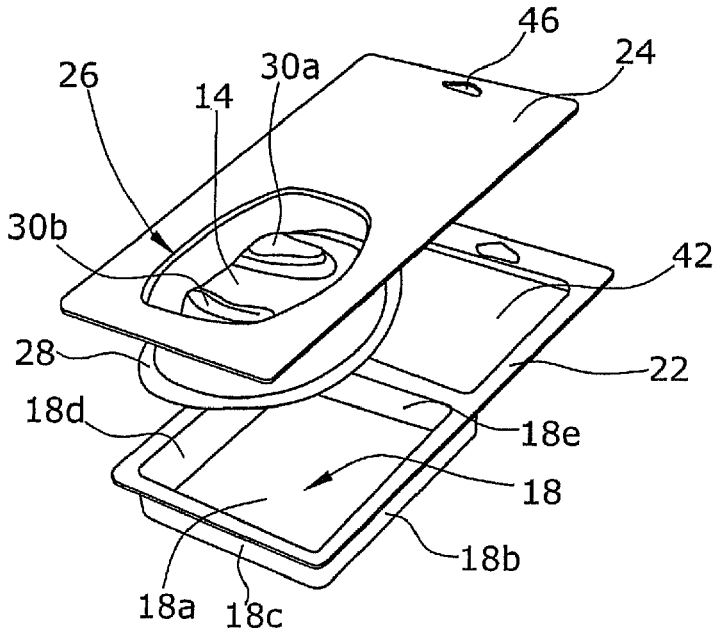
FIG. 2 is a perspective view of the packing of the invention in the non-assembled state.

As illustrated in FIGS. 1 and 2, the packing of the invention comprises a base element 22 and a front element 24 which are connected to each other by gluing. Said front element 24 comprises a recess 26 through which the pedestal 14 extends in the direction of the observer toward the front side A of the packing. The first pedal 12*a*, not shown in FIGS. 1 and 2, will be placed on the pedestal 14. Pedestal 14 comprises a first dome 30*a* and a second dome 30*b*. The pedestal further comprises a continuous edge 28 having a larger perimeter than the recess 26 of front element 24. By said edge 28, it is prevented that the pedestal 14 falls out via recess 26 of front element 24 in the direction of the observer toward the front side A of the packing. Pedestal 14 can be connected to front element 24, e.g. by gluing. However, it can also be provided that the pedestal 14 is merely held in recess 26 and does not comprise any further connection to front element 24.

In base element 22, a first cavity 18 is formed for accommodating the second pedal 12*b*, also the latter being not shown in FIGS. 1 and 2. Said cavity 18 is closed at its front side by pedestal 14 and, in the edge regions of the front side, by front element 24 so that the second pedal 12*b* is not visible to the observer. At the rear side B of packing 10, cavity 18 comprises a rear-side back wall element 18*a*. Further, for lateral delimitation of the receiving cavity 18, four side walls or lateral back wall elements 18*b*, 18*c*, 18*d*, 18*e* are provided on base element 22. The volume of receiving cavity 18 is adapted to the dimensions of second pedal 12*b*.

Above the first receiving cavity 18, base element 22 comprises a second receiving cavity 42 for storing therein an instruction manual or other product information. Said second receiving cavity 42 can have smaller dimensions, particularly a smaller depth, than the first receiving cavity 18 for the second pedal 12*b* so that the packing has a lower depth in its upper region.

Further, the front element 24 and the base element 22 can be enclosed by a transparent plastic sheathing, not shown, as known from packing technology. Also this transparent sheathing can comprise a recess in the region of recess 26 of front element 24, so that the pedestal 14 together with the first pedal 12*a* extends through this plastic sheathing and can be touched by an interested observer.

Figure 3:
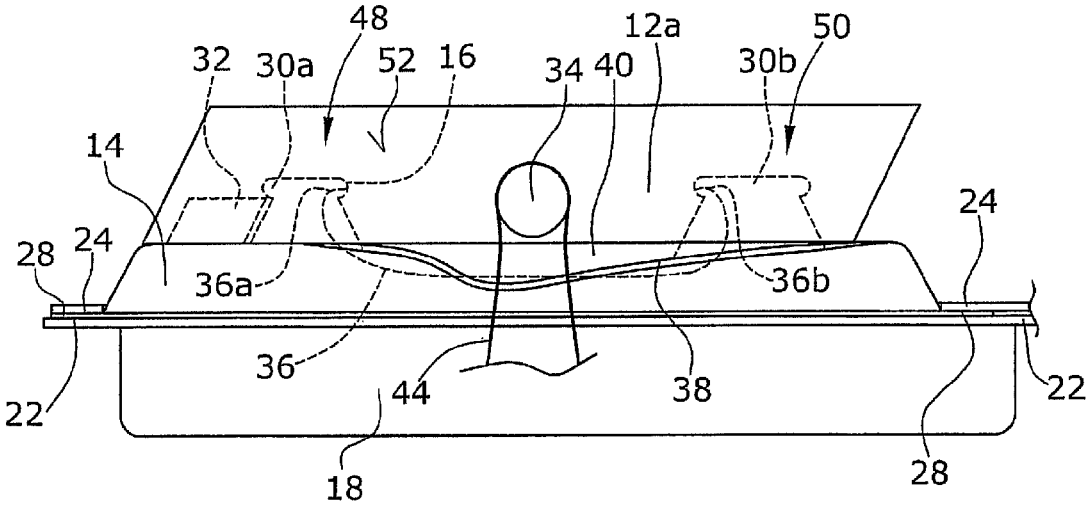
FIG. 3 is a partially sectional schematic view of the packing of the invention.

FIG. 3 illustrates the manner in which the pedestal 14 12*a* is fixed by the domes 30*a*,30*b*. The two domes 30*a*,30*b* engage a respective recess 48 and respectively 50 of pedal 12*a*. In its interior, pedal 12*a* comprises a plurality of undercuts 32 which can be configured in any desired manner. It is preferred that said undercuts 32 are arranged in the central region of pedal 12*a* or in its upper third, but not above its upper side 52. Thus, it is possible to fix the pedal 12*a* on pedestal 14 without requiring that the two domes 30*a*,30*b* extend beyond pedal 12*a*.

Fixing the pedal 12*a* is effected in that the two domes 30*a*,30*b* comprise, at their upper end, an elastically deformable, continuously surrounding rear-engagement portion 16 for engagement behind the undercuts 32 of the first pedal 12*a*.

To obtain a more stable attachment of pedal 12*a* on pedestal 14, there is further provided a metal clamp 36 comprising a first and a second fastening projection 36*a*,36*b*. Each of these fastening projections 36*a*,36*b* is guided in a respective one of the two domes 30*a*,30*b* and, in addition to the elastically deformable rear-engagement portion 16 of dome 30*a*, 30*b*, engages behind a respective one of the undercuts 32 of first pedal 12*a*.

An additional connection of the first pedal 12*a* to the second pedal 12*b*, which is arranged directly under the first pedal 12*a* in the receiving cavity 18, is achieved by a twistable wire 44 guided around the two axes 34 of the pedals 12*a*,12*b*. Said wire is fitted through two recesses, not shown, in pedestal 14.

In FIG. 3, it can be further seen that the pedestal 14 comprises a surrounding edge 28 extending parallel to the front element 24 and arranged between the latter and the base element 22.

FIG. 3 further shows a recess 38 in pedestal 14. Said recess 38 serves for receiving an abutment element 40 of first pedal 12*a* which, at the inner side of the footplate of pedal 12*a*, extends vertically to the footplate at an angle of 60° to 90° relative to the pedal axis 34 away from the pedal.

The size of pedestal 14 can be adapted to various pedal sizes, while it is not necessary to adapt the further components 22 and 24 of the packing to the changed pedal size.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. A packing for bicycle pedals, comprising:

first and second pedals having recesses, a pedestal for supporting the first pedal thereon, the shape of the pedestal being adapted to the outer contours of the first pedal, a fixing means for fixing the first pedal on the pedestal, and a receiving cavity for the second pedal, wherein the pedestal comprises two domes, the shapes and dimensions of said domes being in agreement with said recesses formed in the first pedal, said two domes comprising, at their tip, an elastically deformable rear-engagement portion for engagement behind an undercut of the first pedal, wherein the two domes of the pedestal are arranged at a mutual distance, thereby forming an intermediate space, in a direction transverse to the axis of the first pedal so that the axis of the first pedal can be received in the intermediate space.

2. The packing of claim 1, wherein a front side of the receiving cavity, comprising the side of the receiving cavity facing toward the observer, is closed by the pedestal, and a rear side and lateral back wall side portions of the receiving cavity are closed by at least one rear wall element.

3. The packing of claim 2, wherein said rear wall element is formed by a base element of the packing and the packing further comprises a front element wherein said base element is connected to the pedestal.

4. The packing of claim 3, wherein the front element comprises a recess whose shape and dimensions substantially correspond to those of the pedestal, wherein, in the assembled state of the packing, the pedestal extends from the rear through said recess in the direction of the observer, and wherein the pedestal is provided with a circumferential edge on its lower region for keeping the pedestal fixed in the recess of the front element, said edge circumferential extending parallel to the front element between the front element and the base element.

5. The packing of claim 1, wherein the receiving cavity for the second pedal is closed on a side facing toward the observer by the pedestal and/or a front element so that the contents of the receiving cavity are not visible to the observer.

6. The packing of claim 1, wherein an elastically deformable fastening clamp is provided for attachment of the first pedal to the pedestal, said fastening clamp comprising two fastening projections, wherein, with the first pedal mounted to the pedestal, a respective fastening projection is fitted into one of the two domes of the pedestal and to the elastically deformable rear-engagement portion of the dome, thereby engaging behind an undercut of the first pedal.

7. The packing of claim 1, wherein when the first pedal is attached to the pedestal of the packing, the first pedal is in contact with the pedestal only by a lower portion of the pedal, wherein the attachment of the pedal on the pedestal occurs only at the lower portion of the pedal so that five faces of the pedal are not covered by any element of the packing and thus are visible to and/or touchable by an interested person.

8. The packing of claim 1, wherein the pedestal comprises, at a side thereof, a recess for receiving an abutment element of the first pedal.

9. The packing of claim 1, wherein a second receiving cavity is provided for accommodating an instruction manual or other product information, said second receiving cavity being formed between a base element and a front element of the packing.

10. The packing of claim 1, wherein the pedestal is made of papier-mâché and a base element and a front element of the packing are made of cardboard.

11. The packing of claim 1, wherein the first and the second pedals are arranged above each other in the packing, the pedestal being arranged between them and the first and the second pedals being connected to each other and to the packing via a recess in the pedestal with the aid of a connection element.

* * * * *